US005364542A

United States Patent [19]

Birkhan et al.

[11] Patent Number: 5,364,542

[45] Date of Patent: Nov. 15, 1994

[54] FABRIC SOFTENER RINSING AGENTS

[75] Inventors: Horst Birkhan, Steinau-Ulmbach; Hans-Juergen Köhle, Schlüchtern; Joachim Welgand, Freigericht; Winfried Wehner, Neuhof, all of Germany

[73] Assignee: Rewo Chemische Werke GmbH, Germany

[21] Appl. No.: 936,609

[22] Filed: Aug. 27, 1992

Related U.S. Application Data

[63] Continuation of Ser. No. 564,873, Aug. 9, 1990, Pat. No. 5,180,508.

[30] Foreign Application Priority Data

Aug. 12, 1989 [DE] Germany ..... 3926740

[51] Int. Cl.[5] ..... D06M 13/46

[52] U.S. Cl. ..... 252/8.8; 252/8.6; 252/8.9

[58] Field of Search ..... 252/8.6, 8.7, 8.75, 252/8.8, 8.9

[56] References Cited

U.S. PATENT DOCUMENTS

| | | | |
|---|---|---|---|
| 3,997,453 | 12/1976 | Wixon . | |
| 4,073,735 | 2/1978 | Ramachandran | 252/8.8 |
| 4,187,289 | 2/1980 | Eckhardt | 252/8.8 |
| 4,214,998 | 7/1980 | Joy | 252/8.8 |
| 4,341,644 | 7/1982 | Bisschops et al. | 252/8.8 |
| 4,439,335 | 3/1984 | Burns | 252/8.75 |
| 4,789,491 | 12/1988 | Chang et al. | 252/8.75 |
| 4,795,573 | 1/1989 | Tsumadori et al. | 252/8.8 |
| 4,844,823 | 7/1989 | Jacques et al. | 252/8.8 |
| 4,963,274 | 10/1990 | Ruback et al. | 252/8.75 |
| 5,066,414 | 11/1991 | Chang | 252/8.8 |
| 5,133,885 | 7/1992 | Contor et al. | 252/8.6 |
| 5,180,508 | 1/1993 | Birkhan et al. | 252/8.6 |

FOREIGN PATENT DOCUMENTS

| | | |
|---|---|---|
| 079643 | 5/1983 | European Pat. Off. . |
| 0165138 | 12/1985 | European Pat. Off. . |
| 0295386 | 4/1988 | European Pat. Off. . |
| 293955 | 12/1988 | European Pat. Off. . |
| 0296995 | 12/1988 | European Pat. Off. . |
| 302567 | 2/1989 | European Pat. Off. . |

*Primary Examiner*—Paul Lieberman
*Assistant Examiner*—Michael P. Tierney
*Attorney, Agent, or Firm*—Scully, Scott, Murphy & Presser

[57] ABSTRACT

The present invention relates to a soft-rinsing agent comprising a mixture of two soft-rinsing components, each of which is a quaternary salt as described herein. The mixture may contain 10–90% of the first component and 90–10% by the second component.

51 Claims, No Drawings

FABRIC SOFTENER RINSING AGENTS

This is a continuation of copending application Ser. No. 564,873, filed on Aug. 9, 1990 now U.S. Pat. No. 5,180,508.

The present invention relates to softener rinsing agents for fabrics in the form of aqueous emulsions or dispersions.

BACKGROUND

As is known, when textiles are washed, so-called soft-rinsing agents are employed in the final washing process in order to reduce the hardening of the fabrics caused by drying and to exert an attractive effect on the handle of the treated textiles.

The soft-rinsing agents employed are usually cationic compounds, for example, quaternary ammonium compounds, which, in addition to long-chain alkyl radicals, can also contain ester or amide groups. It is also advantageous to use mixtures of various softening components, which are added to the rinsing bath in the form of aqueous dispersions.

Although these cationic compounds are effective softeners when used in the final rinsing bath, they still display certain disadvantages in use.

One of the disadvantages of agents of this type is that the softening components cannot be dispersed in cold water; in addition, the re-wetting capacity of the textiles treated with them is not yet satisfactory.

The re-wetting capacity is understood to mean, in general, the absorption of moisture by the fibers. A defective re-wetting capacity has, however, disadvantages in cases where fairly large amounts of moisture are to be absorbed from the surface of the skin, for example in hand towels or bath towels and also in underwear or bed linen.

The object of the present invention is to overcome the above-mentioned disadvantages of conventional soft-rinsing formulations and to provide fabric softener rinsing agents which, in addition to good biodegradability and soft handle, possess an appreciably improved dispersibility and an improved re-wetting capacity.

It has been found, surprisingly, that textile soft-rinsing agents composed of mixtures of water-insoluble quaternary ammonium compounds containing ester groups together with salts of monoamine or polyamine compounds, which can be prepared by protonation with inorganic or organic acids, fulfil these requirements.

SUMMARY OF THE INVENTION

The present invention therefore relates to an aqueous soft-rinsing agent a mixture of two soft-rinsing components, said mixture comprising a first component and a second component, said first component comprising (a) a quaternary compound of the formula:

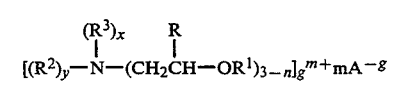

I wherein each R is independently hydrogen or lower alkyl;

each $R^1$ is hydrogen or an alkylcarbonyl group containing 15–23 carbon atoms, provided that at least one of $R^1$ is an alkylcarbonyl group;

each $R^3$ is an alkyl group containing 1–4 carbon atoms which is unsubstituted or substituted with 1, 2, or 3 hydroxy groups;

each $R^2$ is an alkyl group containing 1–4 carbon atoms which may be unsubstituted or substituted with 1, 2, or 3 hydroxy groups, or is a group of the formula

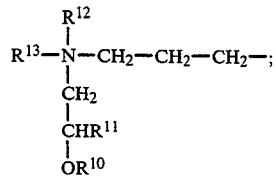

II $R^{13}$ is an alkyl group containing 8–22 carbon atoms;

$R^{12}$ is an alkyl group containing 1–4 carbon atoms which is unsubstituted or substituted with 1, 2, or 3 hydroxy groups;

$R^{11}$ is hydrogen or lower alkyl;

$R^{10}$ is hydrogen or alkylcarbonyl group containing 14–22 carbon atoms;

A is an anion of a quaternizing agent;

n is 0 or 1;

x and y are independently 0 or 1 with the proviso that $(x+y)+(3-n)=4$; and m is 1 or 2; and g is 1, 2 or 3, such that $(m/g)(g)=m$, and (b) said second component comprising at least one compound of the formula:

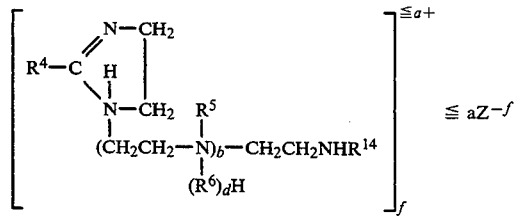

III

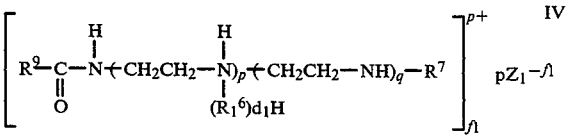

IV $$[R^{15}R^{16}NR^{17}H]_{f2}^{+}\ Z_2^{-f2}$$

V

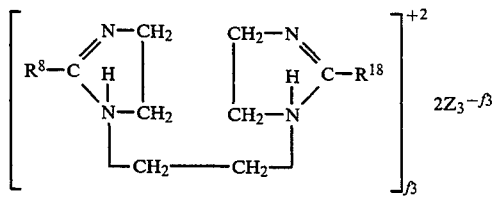

VI wherein $R^4$ is an alkyl radical having 8–22 carbon atoms;

$R^5$ is hydrogen or $R^6$;

$R^6$ and $R_1^6$ are independently CHX—CHY—O;

X and Y are independently hydrogen or lower alkyl with the proviso that X and Y cannot simultaneously be alkyl;

$R^{14}$ is hydrogen or alkylcarbonyl group containing 14–22 carbon atoms;

$R^7$ is an alkylcarbonyl group containing 14–22 carbon atoms or H;

$R^{15}$ is an alkyl radical having 1–4 carbon atoms which is unsubstituted or substituted with 1, 2, or 3 hydroxy groups;

$R^{16}$ and $R^{17}$ are independently an alkyl group containing 8–22 carbon atoms;

$R^9$ is an alkyl group containing 14–22 carbon atoms;

$R^8$ and $R^{18}$ are independently an alkyl group containing 11–17 carbon atoms;

Z, $Z_1$ $Z_2$ and $Z_3$ are independently water-soluble monobasic or polybasic anion;

b is 1, 2 or 3;

d and $d_1$ are independently 0–6;

a is b+1;

f, $f_1$, $f_2$ and $f_3$ are independently 1, 2, or 3;

m and $m_1$ are independently 0–6;

q is 0 or 1; and p is 1–3 provided p+q is ≧2.

DETAILED DESCRIPTION OF THE INVENTION

In the above formulae, the anions Z, $Z_1$, $Z_2$, $Z_3$, and A are merely present as a counterion of the positively charged quaternary ammonium compounds. The nature of the counterion is not critical at all to the practice of the present invention. The scope of this invention is not considered to be limited to any particular anion.

As used herein, the term "lower alkyl", when used alone or in combination, refers to an alkyl group containing 1–6 carbon atoms. These carbon atoms may be linear or branched and include such groups as methyl, ethyl, propyl, isopropyl, butyl, isobutyl, sec-butyl, t-butyl, pentyl, amyl, and the like. It is preferred that the lower alkyl group is a straight chain.

The term "alkyl carbonyl" as used herein refers to a carbonyl group attached to an alkyl group wherein the total number of carbon atoms in the "alkyl carbonyl" group ranges from 15–23. It is the carbonyl group, $$\overset{\overset{\displaystyle C,}{\|}}{O}$$

which is the bridging linkage between the alkyl group and the backbone of the molecules of the present invention, as described herein. The alkyl carbonyl group may be a straight chain or a branched chain, but it is preferred that it is a straight chain. The alkyl carbonyl group may also contain one or two double or triple carbon carbons bonds. But, it is preferred that the alkyl portion of the alkyl carbonyl group be completely saturated. It is most preferred that the alkyl part of the carbonyl group be saturated and linear. The preferred alkylcarbonyl groups have the formula $$-\underset{\underset{\displaystyle O}{\|}}{C}C_nH_{2n+1}$$

wherein n is 14–22. Examples include tridecylcarbonyl, tetradecylcarbonyl, pentadecylcarbonyl, hexadecylcarbonyl, heptadecylcarbonyl, octadecylcarbonyl, nonadecylcarbonyl, eicosanylcarbonyl, heneicosanylcarbonyl and the like.

As indicated hereinabove, the present invention relates to an aqueous soft-rinsing agent containing a mixture of two soft-rinsing components composed of two components. The first component consists of a quaternary compound of the formula $$[(R^2)_y-\overset{\overset{\displaystyle (R^3)_x}{|}}{N}-(CH_2\overset{\overset{\displaystyle R}{|}}{C}H-OR^1)_{3-n}]_g^{m+}\ mA^{-g}$$

wherein R, $R^1$, $R^2$, $R^3$, A, y, x, n, m and g are as defined hereinabove. Since the compound of Formula I is a salt, the compound is neutral, so that the charge of the cationic portion of the compound is equal to the total charge of the anionic portion of the molecule. For example, if m is 1, the cation has a charge of +1. If g is 3, then the anion (A) has a charge of −3. To make the compound neutral, there must be g, i.e., in the example, 3, cations relative to the one anion.

$A^{-g}$, as defined hereinabove, is an anion of a quaternizing agent, i.e. an anion to neutralize the cationic portion of the molecule. Examples of the quaternizing agent used are lower alkyl phosphates and sulfate, e.g. dimethyl sulfate, diethyl sulfates, dimethyl phosphate or ethyl phosphate, or lower halogenated alkyl containing 1–6 carbon atoms, e.g. methyl chloride. It is preferred that the halogenated alkyls contain 1–3 halo atoms. The preferred halo is chloro or bromo.

The anions of the quaternary agents are the anions of the group listed hereinabove, e.g. the anion of dimethyl sulfate, methyl chloride and the like. The preferred anion of the quaternizing agent is the anion of dimethyl sulfate, diethyl sulfate and methyl chloride.

Looking at the compound of Formula I, the cation portion of the molecule contains 4 groups around the central nitrogen (N) atom therein. However, the type of groups around the central nitrogen may vary. As defined herein, the cation portion of the molecule has the formula $$(R^2)_y-\overset{\overset{\displaystyle (R^3)_x}{|}}{N}-(CH_2-\overset{\overset{\displaystyle R}{|}}{C}H-OR^1)_{3-n}$$

wherein x+y+3−n=4, x=0 or 1, y=0 or 1 n=0 or 1.

As defined herein, there are at least two groups of ($CH_2$—CHR—$OR^1$) around the central nitrogen. In such a case when n=1, then both $R^2$ and $R^3$ must be present. On the other hand, when n=0, then either one, but not both of $R^2$ and $R^3$ must be present.

As noted hereinabove, the group $$\left(-CH_2-\underset{\underset{\displaystyle R}{|}}{C}H-OR^1\right)$$

is repeated, however, each time, the R group may be the same or different. Similarly each $R^1$ group may be the same or different.

As defined hereinabove, $R^1$ may be an alkyl carbonyl containing 15–23 carbon atoms or hydrogen. It is to be noted that at least one $R^1$ group, when it appears, must be an alkyl carbonyl group. The preferred alkyl carbonyl group contains 16–18 carbon atoms.

The preferred value of R is hydrogen or methyl.

The preferred $R^3$ is a lower alkyl group containing 1–4 carbon atoms. It is preferred that said group is saturated and linear. It is preferred that said group can be unsubstituted or substituted with one or two hydroxy groups.

$R^2$ can be a lower alkyl group containing 1–4 carbon atoms. When $R^2$ is such a group, it is preferred that said group is saturated and linear. However, $R^2$ can also include a moiety of formula II:

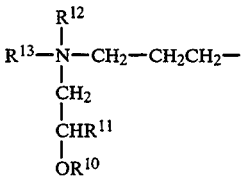

II wherein $R^{10}$, $R^{11}$, $R^{12}$ and $R^{13}$ are as defined hereinabove.

The preferred value of $R^{10}$ is hydrogen or a linear saturated alkylcarbonyl group containing 15–18 carbon atoms.

It is preferred that $R^{11}$ is hydrogen or methyl.

The most preferred value of $R^{12}$ is a linear saturated alkyl group containing 1–4 carbon atoms. It is preferred that said group is unsubstituted, but said group may also be substituted with one or two hydroxy groups in a preferred embodiment. The preferred $R^{13}$ group is a saturated linear alkyl group containing 12–18 carbon atoms. It is especially preferred that $R^{13}$ contain 16–18 carbon atoms.

The value of "m" depends upon the number of quaternary nitrogen atoms present in the molecule. As defined herein, it is preferred that m is 1 or 2.

The preferred compounds of the first component have the following formulae:

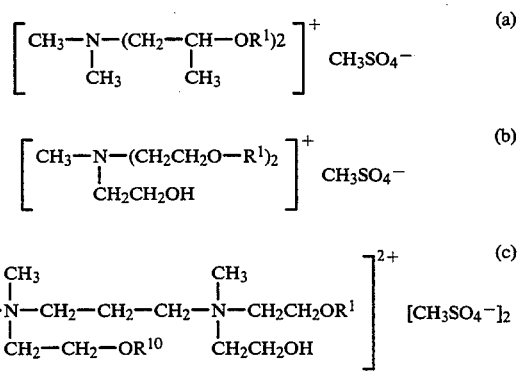

(a)

(b)

(c)

In these formulae, $R^1$, $R^{13}$, and $R^{10}$ are as defined hereinabove. However, it is preferred that $R^1$ and $R^{10}$ are independently

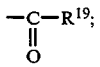

wherein $R^{19}$ is an alkyl group containing 13–20 carbon atoms and more preferably 15–17 carbon atoms. It is especially preferred that $R^{19}$ is linear and completely saturated, although it may also contain one or two double or triple carbon-carbon bonds.

The second component in the mixture contains at least one compound of the formulae

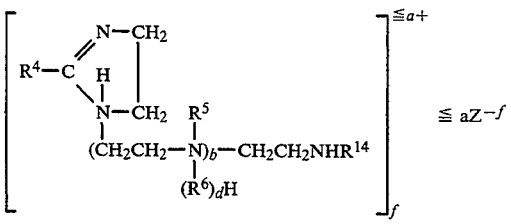

III

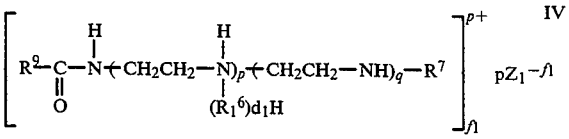

IV $$[R^{15}R^{16}NR^{17}H]_{f2}{}^{+}\ Z_2{}^{-f2}$$

V

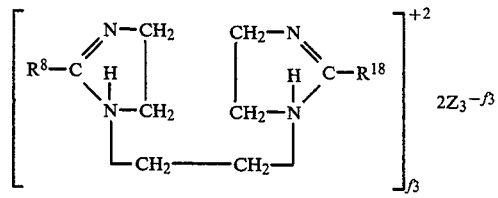

VI

In the above formulae, $Z^{-f}$, $Z_1{}^{-f1}$, $Z_2{}^{-f2}$ and $Z_3{}^{-f3}$ each represent the anion of a water soluble, monobasic or polybasic inorganic or organic acid, such as lower alkyl-sulfuric acid, methylsulfuric acid, ethylsulfuric acid, hydrogen halide acid (e.g. HCl, HBr, HI, or HF), phosphoric acid, sulfuric formic acid, acetic acid, oxalic acid, glycolic acid, citric acid, tartaric acid, and malic acid. Thus, the anions of the acids listed are methylsulfate, ethylsulfate, halide, monobasic phosphate ($H_2PO_4^-$), dibasic phosphasphate ($HPO_4^=$), tribasic phosphate ($PO_4^{\equiv}$), formate, citrate, oxalate, glycolate, citrate, malate, and tartrate. The most preferred anions are lactate and chloride.

Formula III is an imidazoline derivative. It is to be noted that the group

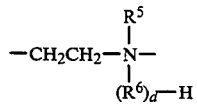

IIIB can be repeated (b) times, wherein b is 1, 2, or 3. For example, if b is 2, then said group becomes

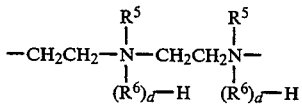

IIIB1

In said group, each $R^5$ can be hydrogen or —CHXCHYO—, in which X and Y can be hydrogen or alkyl, but both cannot be alkyl. It is preferred that X and Y be hydrogen or methyl. The preferred $R^5$ is hydrogen.

Each $R^6$ also denotes the group —CHXCHYO— wherein X and Y are as defined hereinabove. It is preferred that X and Y are independently hydrogen or methyl, provided that both X and Y are not simultaneously methyl. The preferred $R_6$ is —$CH_2CH_2O$—.

$R^6$ can be repeated d times, i.e. 1–6 times. Thus, in the above formula, IIIB wherein b is 2, then the formula becomes

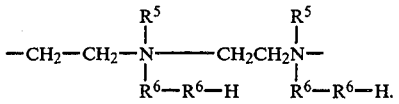

IIIc

In formula III, there is a positive charge on the imidazoline portion of the cation. In addition, there is a positive charge each time the

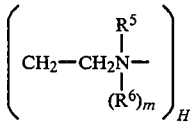

subunit is repeated and this subunit can be repeated b times. Thus the charge of the cationic unit must not be greater than b+1 (or a). Since the compound of Formula III is a salt, the negative charge of the anionic portion must equal the positive charge. Thus, the charge on the anionic portion must be multiplied by a. Furthermore, the charge on the cationic portion must be multiplied by f. For example if $Z^{-f}$ is 2, and a is 1, then there must be 2 cationic portions relative to the one anion $Z^-$.

Another second component has the formula:

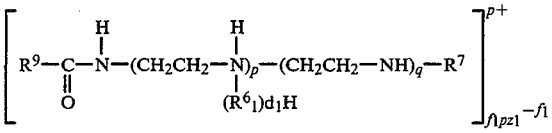

IV wherein $f_1$, $R^9$, $R_1{}^6$, $d_1$, p, q, $R^7$, and Z, are as defined hereinabove.

The compound of Formula IV is a salt. The charge of the cationic portion of the molecule depends on the number of quaternary ammonium groups, i.e., is dependent on p. Since the compound is neutral, then the charge on the anionic portion, $Z_1{}^{-f_1}$ must be multiplied by p and the charge on the cationic portion must be multiplied by $f_1$.

In the above formula, $R_1{}^6$ is defined as CHX—CHY—O, wherein X and Y are the same or different and can be hydrogen or alkyl with the proviso that X and Y cannot simultaneously be alkyl. It is preferred that X and Y are each hydrogen or methyl, provided that both X and Y are not simultaneously methyl. Especially preferred values of $R_1{}^6$ is —$CH_2CH_2O$—.

The preferred values of $R^7$ is a linear saturated alkylcarbonyl groups containing 14–18 carbon atoms. Especially preferred $R^7$ groups contain 16–18 carbon atoms. Nevertheless, $R^7$ can each also have one or two double and/or triple carbon-carbon bonds.

The preferred $R^9$ group is a linear alkyl radical. It may be completely saturated or contain one or two double or triple carbon-carbon bonds. It is especially preferred that $R^9$ contains 17 carbon atoms.

The compound of Formula V has the formula $$[R^{15}R^{16}NR^{17}H]f_2{}^+ \; Z_2{}^{-f2} \qquad \text{V}$$

The compound of Formula V is also a quaternary salt.

The preferred values of $R^{15}$ is a linear saturated alkyl group containing 1–4 carbon atoms and which may be unsubstituted or substituted with one, two or three hydroxy groups.

It is preferred that $R^{16}$ and $R^{17}$ are each independently a linear alkyl radical containing 12–18 carbon atoms. The most preferred values of $R^{16}$ and $R^{17}$ contain 14–16 carbon atoms. However, $R^{16}$ and $R^{17}$ may contain one or two double or triple carbon-carbon bonds.

The formula for another second component is as follows:

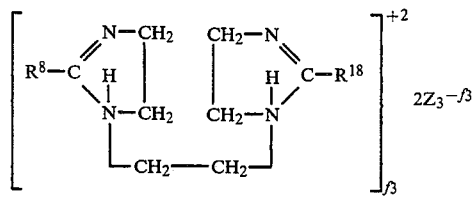

VI wherein $R^8$ and $R^{18}$ are as defined hereinabove. It is to be noted that this compound is a salt of a cation containing 2-imidazoline rings connected by an ethylene group. It is preferred that each $R^8$ and $R^{18}$ are independently linear alkyl groups containing 11–17 carbon atoms. $R^8$ and $R^{18}$ can each contain one or two double or triple carbon-carbon bonds. It is especially preferred that $R^8$ and $R^{18}$ independently each contain 14–18 carbon atoms.

The preferred parent amines of the second component have the formulae:

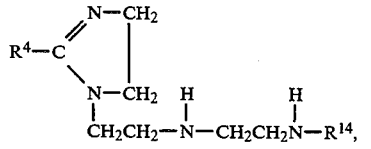

III D

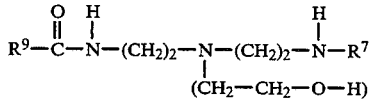

IV a

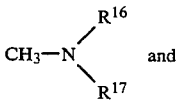

and

V a

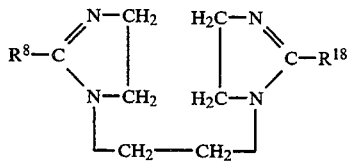

VI A

It is especially preferred that $R^4$, $R^9$, $R^8$ and $R^{18}$ independently represent a linear saturated alkyl radical containing, 14–17 carbon atoms, $R^{14}$ and $R^7$ are independently is

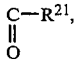

wherein $R^{21}$ is a linear saturated alkyl radical containing 13–20 carbon atoms, and $R^{16}$ and $R^{17}$ each independently represent a linear alkyl radical containing 16–18 carbon atoms. Addition of the monobasic or polybasic inorganic or organic acid under quaternization conditions described hereinbelow will transform these amines into the corresponding quaternary salts.

As indicated hereinabove, the mixture contains two components, a first component and a second component as described herein. The first component may contain one or more compounds having Formula I, while the second component may contain one or more compounds having Formulas III–VI. However, it is preferred that the mixture only contains only said first and second component; thus, the sum of the first component and the second component in the mixture equals 100%. The amount of the first component in the mixture preferably ranges from 10 to 90% by weight while the amount of the second component varies from 90 to 10% by weight of the mixture. It is preferred, however, that the amount of the first component ranges from 20–80% by weight, while the amount of the second component ranges from 80–20% by weight.

The compounds of Formulae I and II–VI are either commercially available or can be prepared by art recognized techniques from commercially available starting materials.

The compounds of Formula I used in the present invention are prepared by art recognized techniques from readily available starting materials. For example, a tertiary alkanolamine of the formula:

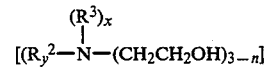

VII wherein $R^2$, $R^3$, $R^1$ are as defined hereinabove and n is 0 or 1 y is 0 or 1

X is 0 or 1 and $(3-n)+x+y=3$ is reacted with an effective amount of an acylating derivative of the fatty acid of the formula $R^1OH$ VIII wherein $R^1$ is an alkylcarbonyl containing 14–22 carbon atoms under esterifcation conditions at a temperature sufficient to effect transesterification and form the product

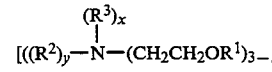

IX

An acylating fatty acid derivative of Formula VIII includes lower alkyl esters and anhydrides of the acid of formula VIII. It is preferred that methyl ester of the fatty acid of formula VIII be used. The reaction can be effected at temperature ranging from 140°–200° C. The reaction may be run in the presence of basic catalysts, such as sodium methylate or sodium carbonate to help facilitate the transesterifications, and the alcohol produced by the reaction, i.e., methanol, is distilled off under vacuum. The glyceride of the fatty acid of Formula VIII can also be used in this reaction.

The product of Formula IX is quaternized with one of the usual quaternizing agents of the formula $(R^2)_yA$, or $(R^3)_xA$ to form a compound of Formula I wherein $R^2$, $R^3$, x, y, m, g, and A are as defined hereinabove. The reaction can be run in an inert solvent, such as 10% isopropanol, at slightly elevated temperatures, such as 40° C.–80° C. A preferred method for forming a compound of Formula IX is by quaternization of the compound of Formula XII with dimethyl sulfate at 60°–70° C. with 10% isopropanol present. The degree of quaternization using this method can reach 95–99%.

The compounds of Formula VII can either be purchased or produced by alkoxylation of the corresponding amine at sufficient temperatures, usually at 90°–150° C., under slightly basic conditions.

The compounds of the second component are either commercially available or are produced by techniques known to one skilled in the art.

Compounds of Formula III are obtained by amidation of polyalkylenepolyamines of the formula:

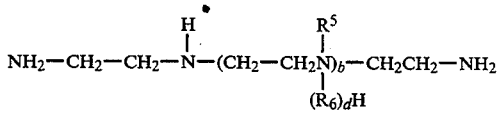

IX wherein, $R^5$, $R^6$, and d are as defined hereinabove, is reacted with

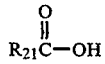

wherein

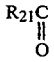

is $R^4$ under amidation and cyclization conditions by heating the reaction mixture to 180°–210° C. under vacuum and removal of the water thus formed in accordance with the procedure described in European Patent Application 345,842. The resulting product is reacted with tosyl chloride to form the corresponding tosylate derivative which is then reacted with aqueous ammonia to form the corresponding amine. The amine is then reacted with an acylating derivative of $R^{14}$-OH under amidation conditions. The resulting product is neutralized with organic or inorganic acid listed hereinabove in an amount equivalent to the amine content at 40°–80° C. in accordance with quaternization conditions known in the art to give a product of Formula III. This reaction can be effected in the presence of an inert solvent. Under these conditions, concentration of free amine in the end product is less than 5%.

The compound of Formula VI which consists of 2-imidazoline rings is prepared from the reaction of

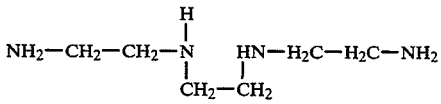

with the appropriate fatty acids under amidation condition in accordance with the procedure described in U.S. Pat. No. 4,339,391 to Hoffman et al., which is incorporated herein by reference, followed by cyclization and heating the reaction mixture to 180°–210° C. under vacuum and removal of the water thus formed in accordance with the procedure described in European Patent Application 345,842. The resulting product is neutralized with organic or inorganic acid (listed hereinabove) in an amount equivalent to the amine content at 40°-80° C., in accordance with guaternization conditions known to one skilled in the art to give the product of Formula VI. This reaction can be effected in the presence of an inert solvent. Under these conditions, the concentration of free amine is less then 5%.

Compounds of Formula IV can be formed by reacting the compound of Formula X

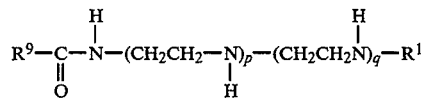

X with the appropriate amount of ethylene oxide optionally in the presence of an inert solvent at 90°-140° C. and at a pressure of 1-4 bars. The resulting product is then neutralized with organic or inorganic acid described above at 40°-80° C. in an amount equivalent to the amine content. This neutralization reaction can be run in an inert solvent.

The compounds of Formula X is formed from the amidation of the corresponding amine with the appropriate fatty acid in accordance with the procedure described in U.S. Pat. No. 4,339,331 which is incorporated herein by reference.

Compounds of Formula V are formed by neutralization of the corresponding amine $R^{15}R^{16}NR^{17}$ with organic or inorganic acid in an amount equivalent to the amine content under quaternization conditions known in the art.

As indicated hereinabove, the first component and the second component comprise the mixture. The mixture, however, comprises the soft-rinsing agent, which also contains adjuvants normally present in soft-rinsing agents. Customary adjuvants can be added to the compositions herein for their known purposes in the preparation of the fabric softener rinsing agents according to the invention. These are, in particular, complexing agents, optical brighteners, dyestuffs and fragrances, electrolytes and viscosity control agents, e.g., ether compounds of fairly high molecular weight, small amounts of organic solvents and—in so far as they do not have a disadvantageous effect on the re-wetting capacity—customary surfactants. In addition, other adjuvants include antioxidants, bacteriocides, and fungicides.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metal of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 6,000 parts per million (ppm), preferably from about 20 to about 4,000 ppm by weight of the composition.

Examples of baceriocides used in the compositions of this invention are glutaraldehyde, formaldehyde, 2-bromo-2-nitropropane-1,3-diol sold by Inolex Chemicals under the trade name Bronopol ®, and a mixture of 5-chloro-2-methyl-4-isothiazolin-3-one and 2-methyl-4-isothiazoline-3-one sold by Rohm and Haas Company under the trade name Kathon ® CG/ICP. Typical levels of bacteriocides used in the present compositions are from about 1 to about 1,000 ppm by weight of the composition.

Examples of antioxidants that can be added to the compositions of this invention are propyl gallate, available from Eastman Chemical Products, Inc., under the trade names Tenox ® PG and Tenox S-1, and butylated hydroxy toluene, available from UOP Process Division under the trade name Sustane ® BHT.

The present compositions may contain silicones to provide additional benefits such as ease of ironing and improved fabric feel. The preferred silicones are polydimethylsiloxanes of viscosity of from about 100 centistokes (cs) to about 100,000 cs, preferably from about 200 cs to about 60,000 cs. These silicones can be used as is, or can be conveniently added to the rinsing compositions in preemulsified form which is obtainable directly from the suppliers. Examples of these preemulsified silicones are 60% emulsion of polydimethylsiloxane (350 cs) sold by Dow Corning Corporation under the trade name DOW CORNING CORPORATION ® 1157 Fluid and 50% emulsion of polydimethylsiloxane (10,000 cs) sold by General Electric Company under the trade name General Electric ® SM 2140 Silicones. The optional silicone component can be used in an amount of from about 0.1% to about 6% by weight of the composition.

It is preferred that the mixture comprises 5-25% of the soft-rinsing agent. It is especially preferred that the mixture comprises 10-25% by weight of the soft-rinsing agent.

By combining the components according to the present invention, one skilled in the art can prepare soft-rinsing agents which have good dispersing power and impart an improved re-wetting capacity, as well as an agreeably soft handle, to textile materials, particularly those composed of natural and regenerated cellulose, and also wool and terry cloth.

In addition to use with the customary textile materials, the soft-rinsing agents according to the invention are therefore employed especially in cases where fairly large amounts of dampness and moisture are to be removed from the body surface within a short time, as in the case of hand towels or bath towels. The soft-rinsing agents according to the invention can, however, also be employed successfully in cases where moisture must be absorbed directly from the skin over fairly long periods of time, as in the case of underwear, linen or bed linen.

The preparation of the soft-rinsing agents is effected by emulsifying or dispersing the particular individual components in water. In this operation it is possible to use the procedures customary in this field.

Usually, the procedure is initially to take water which has been pre-warmed to approx. 10° C. below the clear melting point of the softeners and to dispense into this, successively and with vigorous stirring, first the dyestuff solution, then, if required, the anti-foam emulsion, and finally the clear melt of the individual softeners or the melt of the mixture. After partial addition of an electrolyte solution, perfume oil is next added in, followed by the remaining amount of electrolyte solution, and the mixture is then allowed to cool to room temperature with stirring.

The soft-rinsing agents according to the invention can in each case contain one or more of the first and second components within the limits indicated.

In this regard the ratios are largely uncritical and can be optimized by those skilled in the present field by a few scouting tests using the generally known criteria.

Like the soft-rinsing agents belonging to the known state of the art, the soft-rinsing agents according to the present invention are added subsequently to the actual washing process, in the final rinsing operation. The concentration in which they are used, after dilution with water is within the range from 0.1 to 10 g of soft-rinsing agent per liter of treatment liquor, depending on the application.

The handle is assessed by treating the textile material composed of wool, cotton, 50:3 polyester/cotton and polyester for approx. 3 minutes with a liquor composed of tap water (approx. 13 degrees of German hardness) and 1 g of dispersion according to the invention. The soft handle of the dried textiles was examined by five persons having appropriate experience in assessing the softness of textiles, and assessment was made in comparison with untreated textiles. Textile material dried in this way has an excellent soft, fleecy handle and a re-wetting capacity which is greatly improved compared with commercially available agents.

The re-wetting capacity is measured by a method in accordance with industrial standards which are described in DIN 53 924, with the modification that the strips of fabric (test pieces) are 1.5 cm wide.

Preparation of the Soft-Rinsing Dispersions

The soft-rinsing dispersions according to the invention are prepared from the components indicated in the examples below in accordance with the following procedure:

First the dyestuff solution and then the first and second softener components pre-warmed to 45° C., are dispersed successively, with vigorous stirring (propeller stirrer), in water which has been pre-warmed to 35° C. A partial amount of a 25% calcium chloride solution is then added in such quantities that the whole mixture remains readily stirrable. After a dispersion phase lasting 10 minutes, the perfume oil is added at approx. 35° C. and the viscosity is then adjusted to the desired value at approx. 30° C. by means of the residual amount of the calcium chloride solution. The mixture is allowed to cool to room temperature with continued vigorous stirring and, if possible, with the avoidance of air occlusions.

In a modification of the process indicated, water at 20° C. is initially taken, high-speed stirrers (Ultra Turrax, Example 5) are used and the first and second components are pre-warmed to 30° C. as a mixture and are dispersed into the water at this temperature. The initial viscosities of the mixtures according to the invention were measured using a Brookfield viscometer, type LVT, spindle 1, at 30 revolutions/minute in accordance with the manufacturer's instructions, and are between approx. 40 and 100 mPas at 25° C.

EXAMPLES

Example 1

The aqueous rinsing agent is composed of the following ingredients:

3.00 g of first component, in which $R = H,$ $R^1 = \underset{\underset{O}{\|}}{C}C_{17}H_{35}$ twice, H once $R^3 = CH_3$ $n, y = 0$ $A^{-g} = CH_3SO_3^-$ $x, m = 1$ 12.00 g of second component having formula IV in which $R^7 = C_{17}H_{35}\underset{\underset{O}{\|}}{C}-$ $f_1, p, q = 1,$ $R^9 = C_{17}H_{35};$ $R_1{}^6 = CH_2-CH_2-O-$ in which $d_1 = 3$ $Z_1{}^{-f1}$ = lactate radicals 0.4 g of perfume oil, VERTALIA ® 100457D made by Orissa Dribing, 0.45 g of dyestuff (1% strength solution of SANDOLAN ® Walkblau NBL 150 made by Sandoz), 0.13 g of $CaCl_2$, made up to 100 parts of water of 13 degrees German hardness.

The washed textiles are treated in a customary manner with the rinsing agent of the present invention, which is present in concentrations of 0.1 to 10 g/l, preferably 0.5–3 g/l. In addition to the improved dispersibility caused by the rinsing agent of the present invention, the treated textiles have an excellent soft handle and a re-wetting capacity of 70% (average value of 10 measurements).

As a comparative example, an agent, prepared from 6 g of distearyldimethylammonium chloride (commercially available product), 0.2 g of perfume oil (as in Example 1), 0.2 g of dyestuff (as in Example 1), 0.1 g of silicone antifoaming emulsion Antifoam DB 110 A made by DOW, made up to 100 parts of water at 13 degrees German hardness, had a considerably reduced re-wetting capacity of 50%.

Example 2

This was carried out according to the procedure in Example 1, except that 12 g of the first component and 3 g of the second component described in Example 1 and 0.11 g of $CaCl_2$ were employed.

In addition to an excellent soft handle, the re-wetting capacity was determined to be 90%.

Example 3

This was carried out according to the procedure of Example 1 with the modification that 18 g of the first component and 2 g of the component described in Example 1, and 0.34 g of $CaCl_2$ were employed.

In addition to an excellent soft handle, the re-wetting capacity was determined to be 74%.

Example 4

This was carried out according to the procedure of Example 1, with the modification that 9 g of the first component and 9 g of the second component of Example 1, and 0.19 g of $CaCl_2$ were employed.

In addition to an excellent soft handle, the re-wetting capacity was determined to be 80%.

Example 5

This was carried out according to the procedure of Example 1 except that 12 g of the first component and 3 of the second component described in Example 1, and 0.3 g of $CaCl_2$ were employed.

In addition to excellent dispersibility in cold water and a first-rate soft handle, the re-wetting capacity was determined to be 92%.

Example 6

This was carried out according to the procedure of Example 1 with the modification that 13.5 g of the first component of formula I in which $R = H$ $R^1 = C(=O)-C_{17}H_{35}$ twice; H once $R^3 = CH_3$ $n, y = 0$ $A^{-g} = CH_3SO_3^-$ $x, m = 1$ and 1.5 g of the second component having formula V in which $R^{15} = CH_3$ $R^{16}$ and $R^{17} = C_{18}H_{37}$ $Z_2^{-f2}$ = lactate radical and 0.02 g of silicone antifoaming emulsion Antifoam DB 110 A made by DOW were employed.

In addition to excellent dispersibility in cold water and a first-rate soft handle, the re-wetting capacity was determined to be 70%.

Example 7

This was carried out according to the procedure of Example 6 with the modification that 1.5 g of the second component of Formula III in which $R^4 = C_{17}H_{35}$ $R^{14} = C(=O)-C_{17}H_{35}$ $R_5 = H$, $d = 0$ $b = 1$ $a = 1$ $Z^{-f}$ = lactate radical In addition to excellent dispersibility in cold water and a first-rate soft handle, the re-wetting capacity was determined to be 75%.

Example 8

This was carried out according to the procedure of Example 6 with the modification that 13.5 of the first component of formula I in which $R = H$ $R^1$ = twice $C(=O)-C_{17}H_{35}$ $R^3 = CH_3-$ $R^2$ = formula II in which $R^{10}$ and $R^{11} = H$ $R^{12} = CH_3-$, $R^{13} = CH_{18}H_{37}$, $A^{-g} = CH_3SO_3^-$;

$m = 1$;

$n = 1$;

$x = 0$; and 1.5 g of the second component having formula V in which $R^{15} = -CH_3$ $R^{16}, R^{17} = C_{18}H_{37}-$ $Z_2^{-f2}$ = lactate radical, and 0.02 g of silcone antifoaming emulsion Antifoam DB 110 A made by DOW were employed.

In addition to excellent dispersibitlity in cold water and a first-rate soft handle, the re-wetting capacity was determined to be 70%.

Example 9

This was carried out in accordance with the procedure of Example 8 with the modification that 1.5 g of the second component of formula III in which $R^4$ is $C_{17}H_{35}$ $R^{14} = C(=O)-C_{17}H_{35}$, $R^5 = H$, $d = 0$ $b = 1$ $a = 1$ $Z^{-f}$ = lactate radical In addition to excellent dispersibility in cold water and a first-rate soft handle, the re-wetting capacity was determined to be 68%.

Example 10

This was carried out in accordance with the procedure described in Example 8 with the modification that 1.5 g of the second component of formula IV in which $R^7 = C_{17}H_{35}-C(=O)-$ $f_1$, p and $q = 1$ $R_1^6 = -CH_2-CH_2-O-$ in which $d_1 = 3$ $Z_1^{-f1}$ = lactate radical -continued $R^9 = C_{17}H_{35}$ and 0.17 g of $CaCl_2$ are employed.

In addition to excellent dispersibility in cold water and a first-rate soft handle, the re-wetting capacity was determined to be 74%.

The above preferred embodiments and examples are given to illustrate the scope and spirit of the present invention. These embodiments and example will make apparent, to those skilled in the art, other embodiments and example will make apparent, to those skilled in the art, other embodiments and examples. These other embodiments and examples are within the contemplation of the present invention. Therefore, the present invention should be limited only by the appended claims.

What is claimed is:

1. An aqueous soft rinsing agent comprising as an active ingredient an effective amount of a mixture of two soft-rinsing components, (a) the first component being a quaternary compound of the formula:

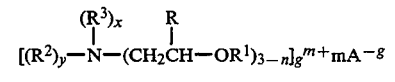

I wherein each R is independently hydrogen or alkyl containing 1–6 carbon atoms;

each $R^1$ is hydrogen or an alkylcarbonyl group containing 15–23 carbon atoms, provided that at least one of $R^1$ is an alkylcarbonyl group;

each $R^3$ is an alkyl group containing 1–4 carbon atoms which is unsubstituted or substituted with 1, 2, or 3 hydroxy groups;

each $R^2$ is an alkyl group containing 1–4 carbon atoms which may be unsubstituted or substituted with 1, 2, or 3 hydroxy groups, or is a group of the formula

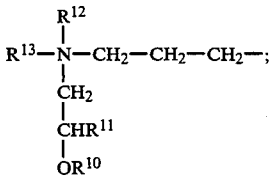

II $R^{13}$ is an alkyl group containing 8–22 carbon atoms;

$R^{12}$ is an alkyl group containing 1–4 carbon atoms which is unsubstituted or substituted with 1, 2, or 3 hydroxy groups;

$R^{11}$ is hydrogen or alkyl containing 1–6 carbon atoms;

$R^{10}$ is hydrogen or alkylcarbonyl group containing 14–22 carbon atoms;

A is an anion of a quaternizing agent;

n is 0 or 1;

x and y are independently 0 or 1 with $(x+y)+(3-n)=4$;

m is 1 or 2; and g is 1, 2 or 3;

and (b) the second component comprising a compound of the formula:

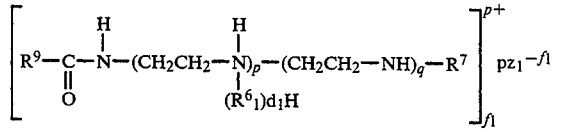

IV wherein X and Y are independently hydrogen or alkyl containing 1–6 carbon atoms with the proviso that X and Y cannot simultaneously be alkyl;

$R^6{}_1$ is CHX—CHY—O;

$R^7$ is alkylcarbonyl group containing 14–22 carbon atoms or H;

$R^9$ is an alkyl group containing 14–22 carbon atoms;

$Z_1$ is a water-soluble monobasic or polybasic anion;

$d_1$ is 0–6;

$f_1$ is 1, 2, or 3;

q is 0 or 1;

p is 1–3; and p+q is ≧2.

2. The soft-rinsing agent according to claim 1 wherein the alkyl groups of R, $R^3$, $R^2$, $R^{13}$, $R^{12}$, $R^{10}$, X, Y and $R^9$ are linear.

3. The soft-rinsing agent according to claim 1 wherein R is H or methyl.

4. The soft-rinsing agent according to claim 1 wherein $R^1$ contains 15–18 carbon atoms.

5. The soft-rinsing agent according to claim 1 wherein $R^3$ is $CH_3$.

6. The soft-rinsing agent according to claim 1 wherein $R^{13}$ contains 10–18 carbon atoms.

7. The soft-rinsing agent of claim 1 wherein $R^{10}$ contains 15–18 carbon atoms.

8. The soft-rinsing compound according to claim 1 wherein $R^{10}$ is hydrogen.

9. The soft-rinsing compound of according to claim 1 wherein $R^{11}$ is hydrogen.

10. The soft-rinsing agent of claim 1 wherein A is the anion of a quaternizing agent selected from the group consisting of lower dialkyl phosphates, lower diaklyl sulfates, or lower alkyl substituted with one or two halogens.

11. The soft-rinsing agent according to claim 10 wherein the anion of the quaternizing agent is selected from the group consisting of dimethyl sulfate, diethyl sulfate or methyl chloride.

12. The soft-rinsing agent of claim 1 wherein $R_1{}^6$, is CHX—CHY—O, and X and Y are independently hydrogen or methyl, with the proviso that X and Y cannot simultaneously be methyl.

13. The soft-rinsing agent according to claim 12 wherein X and Y are both hydrogen.

14. The soft-rinsing agent of claim 1 in which $R^9$ contains 17 carbon atoms.

15. The soft-rinsing agent of claim 1 in which $Z_1$ is the anion of methyl sulfuric acid, ethyl sulfuric acid, hydrogen halide, phosphoric acid, formic acid, acetic acid, oxalic acid, alycolic acid, citric acid, tartaric acid, malic acid, or lactic acid.

16. The soft-rinsing agent according to claim 15 wherein $Z_1$ is an anion of hydrochloric acid or lactic acid.

17. The soft-rinsing agent according to claim 1 wherein adjuvants are additionally present.

18. The soft-rinsing agent according to claim 17 where the adjuvants are selected from the group consisting of water, dye, perfumes, salts, and short chain alcohols.

19. The soft-rinsing agent according to claim 1 wherein the mixture is present in concentrations ranging from 5 to 25% by weight.

20. The soft-rinsing agent according to claim 1 wherein the mixture is present in concentration ranging from 10–25% by weight.

21. The aqueous soft-rinsing agent according to claim 1 in which the first component has the formula:

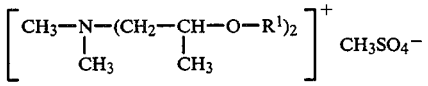

wherein $R^1$ is

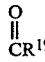

and $R^{19}$ is an alkyl group containing 14–22 carbon atoms.

22. The aqueous soft-rinsing agent according to claim 1 in which the first component has the formula:

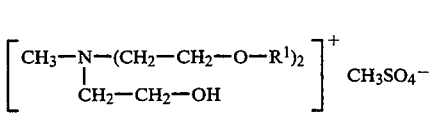

wherein $R^1$ is

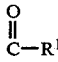

$R^{19}$ is alkyl containing 14–22 carbon atoms.

23. The aqueous soft-rinsing agent according to claim 21 in which $R^{19}$ is an alkyl group containing 15–17 carbon atoms.

24. The agent according to claim 22 wherein $R^{19}$ is an alkyl group contains 15–17 carbon atoms.

25. The aqueous soft-rinsing agent according to claim 1 in which the cation of the second component has the formula:

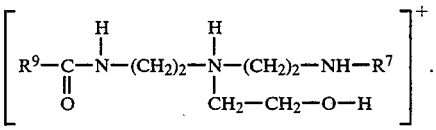

26. The aqueous soft-rinsing agent according to claim 1 in which the first component has having the formula:

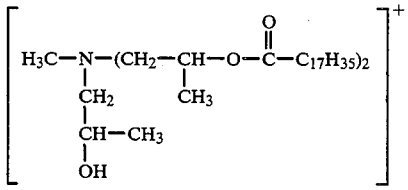

27. The aqueous soft-rinsing agent according to claim 1 in which the second component has the formula:

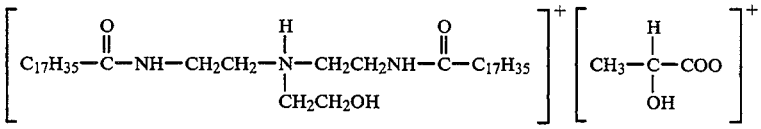

28. The aqueous soft-rinsing agent according to claim 1 wherein the first component is present in the mixture in amounts ranging from 20–80% by weight and the second component is present in the mixture in amounts ranging from 80%–20% by weight.

29. The aqueous soft-rinsing agent according to claim 1 wherein the mixture consists of only a first component and a second component.

30. The aqueous soft-rinsing agent according to claim 1 in which the mixture consists of about 90% by weight of a first component and about 10% by weight of a second component.

31. The aqueous soft-rinsing agent according to claim 1 in which the cation of the first component has the formula:

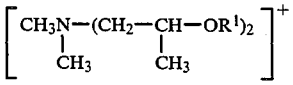

wherein $R^1$ is

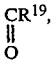

and $R^{19}$ is an alkyl group containing 14–22 carbon atoms.

32. The aqueous soft-rinsing agent according to claim 1 in which the cation of the first component has the formula:

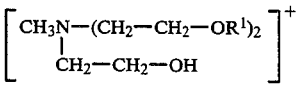

wherein $R^1$ is

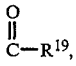

and $R^{19}$ is alkyl containing 14–22 carbon atoms.

33. The aqueous soft-rinsing agent according to claim 31 in which $R^{19}$ is an alkyl group containing 15–17 carbon atoms.

34. The aqueous soft-rinsing agent according to claim 32 wherein $R^{19}$ is an alkyl group containing 15–17 carbon atoms.

35. The aqueous soft-rinsing agent according to claim 1 in which the cation of the second component has the formula:

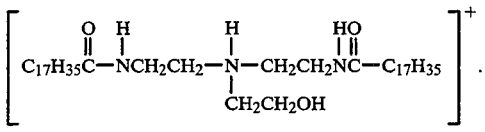

36. The aqueous soft-rinsing agent according to claim 1 in which the mixture consists of a first component and a second component, the cation of the first component having the formula

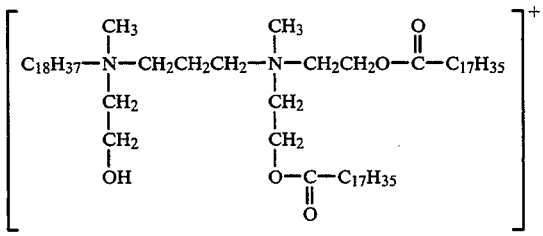

and the cation of the second component has the formula:

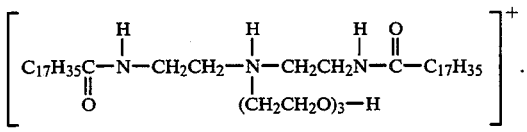

37. The aqueous soft-rinsing agent according to claim 1 in which the alkyl carbonyl in $R^1$, $R^{10}$ and $R^7$ contains 16–18 carbon atoms.

38. The aqueous soft-rinsing agent according to claim 1 in which the first component has the formula:

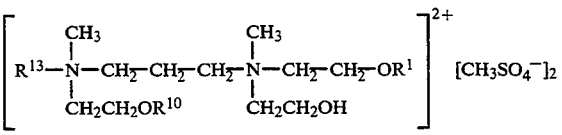

wherein $R^{13}$ is an alkyl group containing 8–22 carbon atoms, $R^1$ is

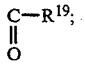

$R^{10}$ is

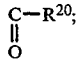

$R^{19}$ is an alkyl group containing 14–22 carbon atoms; and $R^{20}$ is an alkyl containing 13–20 carbon atoms.

39. The agent according to claim 38 wherein $R^{13}$ contains 16–18 carbon atoms.

40. The agent according to claim 38 wherein $R^{19}$ and $R^{20}$ independently contain 15–17 carbon atoms.

41. The aqueous soft-rinsing agent according to claim 1 in which the mixture consists of a first component having the formula:

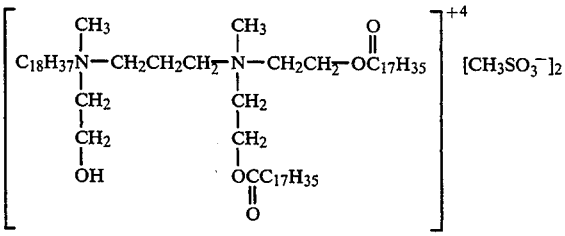

and the second component has the formula

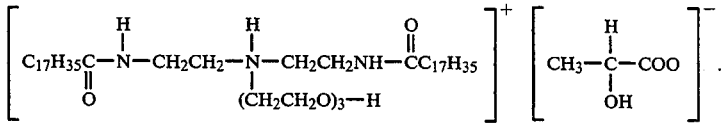

42. The aqueous soft-rinsing agent according to claim 1 in which the cation of the first component has the formula:

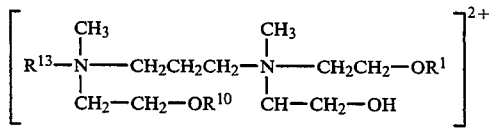

wherein $R^{13}$ is an alkyl group containing 8–22 carbon atoms, $R^1$ is

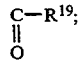

$R^{10}$ is

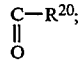

$R^{19}$ is an alkyl group containing 14–22 carbon atoms and $R^{20}$ is an alkyl containing 13–20 carbon atoms.

43. The agent according to claim 42 wherein $R^{13}$ contains 16–18 carbon atoms.

44. The agent according to claim 42 wherein $R^{19}$ and $R^{20}$ independently contain 15–17 carbon atoms.

45. The aqueous soft-rinsing agent according to claim 1 in which the mixture consists of a first component of the formula:

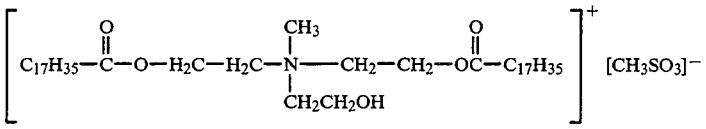

and a second component of the formula

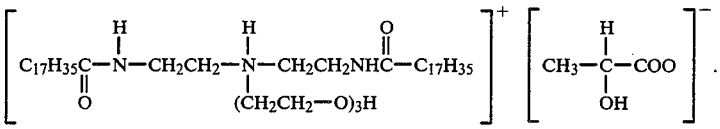

46. The aqueous soft-rinsing agent according to claim 45 in which the mixture consists of about 25% by weight of the first component and about 75% by weight of the second component.

47. The aqueous soft-rinsing agent according to claim 45 in which the mixture consists of about 75% by weight of the first component and about 25% by weight of the second component.

48. The aqueous soft-rinsing agent according to claim 45 in which the mixture consists of about 90% by weight of the first component and about 10% by weight of the second component.

49. The aqueous soft-rinsing agent according to claim 45 in which the mixture consists of about 43% by weight of a first component and 57% by weight of a second component.

50. The aqueous soft-rinsing agent according to claim 1 in which the mixture consists of a first component and a second component, in which the cation of the first component has the formula

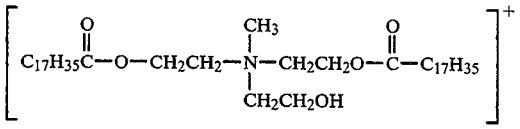

and the cation of the second component has the formula:

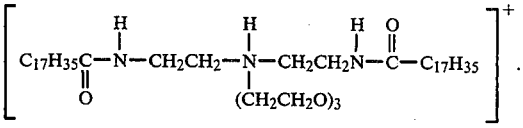

51. The agent according to claim 1 in which the cation of the first component has the formula:

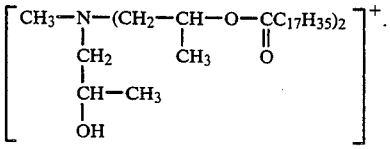

* * * * *

UNITED STATES PATENT AND TRADEMARK OFFICE

CERTIFICATE OF CORRECTION

PATENT NO. : 5,364,542

DATED : November 15, 1994

INVENTOR(S) : Horst Birkhan, et al.

It is certified that error appears in the above-indentified patent and that said Letters Patent is hereby corrected as shown below:

On the Title Page, Section [75]: "Welgand" should read --Weigand--

Column 2, lines 42-46: "

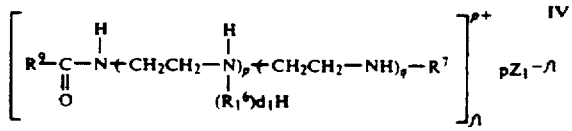

IV "

should read as --

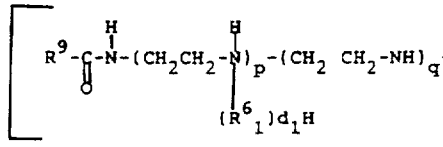

IV --

Column 6, lines 12-16: "

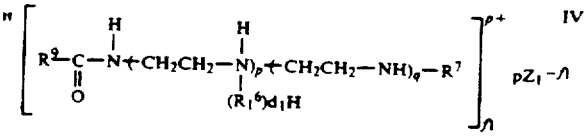

IV "

should read as --

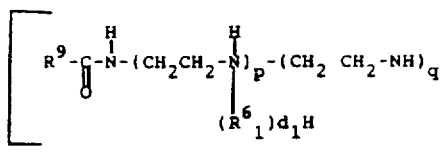

IV --

UNITED STATES PATENT AND TRADEMARK OFFICE

CERTIFICATE OF CORRECTION

PATENT NO. : 5,364,542

DATED : November 15, 1994

INVENTOR(S) : Horst Birkhan, et al.

It is certified that error appears in the above-indentified patent and that said Letters Patent is hereby corrected as shown below:

Column 10, line 17: "art," should read --art.--

Column 11, line 6: "guaternization" should read --quaternization--

Column 22, line 17, Claim 41: "+4" should read --++--.

Signed and Sealed this

Fifth Day of November, 1996

*Attest:*

*Attesting Officer*

BRUCE LEHMAN

*Commissioner of Patents and Trademarks*